US008888072B1

(12) United States Patent
Orgeron

(10) Patent No.: US 8,888,072 B1
(45) Date of Patent: Nov. 18, 2014

(54) UNDERWATER FAIRLEAD ASSEMBLY

(75) Inventor: Keith J. Orgeron, Spring, TX (US)

(73) Assignee: T&T Engineering Services, Inc., Tomball, TX (US)

( * ) Notice: Subject to any disclaimer, the term of this patent is extended or adjusted under 35 U.S.C. 154(b) by 283 days.

(21) Appl. No.: 12/968,155

(22) Filed: Dec. 14, 2010

Related U.S. Application Data

(60) Provisional application No. 61/286,137, filed on Dec. 14, 2009.

(51) Int. Cl.
*B66D 3/08* (2006.01)

(52) U.S. Cl.
USPC ..... 254/393

(58) Field of Classification Search
USPC ..... 254/393, 395, 389, 415; D8/360; 114/230.2
See application file for complete search history.

(56) References Cited

U.S. PATENT DOCUMENTS 4,070,981 A * 1/1978 Guinn et al. ..... 114/293
4,311,109 A * 1/1982 Webb ..... 114/220
4,640,496 A * 2/1987 Van Hoomissen et al. ... 254/415
4,742,993 A * 5/1988 Montgomery et al. ..... 254/389
5,321,902 A * 6/1994 Gregory ..... 37/397
5,845,893 A * 12/1998 Groves ..... 254/389
6,123,804 A * 9/2000 Babassi et al. ..... 156/345.51
6,148,755 A * 11/2000 Wudtke et al. ..... 114/230.2
6,764,093 B2 * 7/2004 Allsop et al. ..... 280/653
6,817,595 B1 * 11/2004 Jenkins et al. ..... 254/389
7,104,214 B2 * 9/2006 Niebur ..... 114/230.2
7,152,349 B1 * 12/2006 Rowlands ..... 37/397
7,240,633 B2 * 7/2007 Barlow ..... 114/200
8,544,403 B2 * 10/2013 Åstrand ..... 114/230.2

* cited by examiner

*Primary Examiner* — Emmanuel M Marcelo
*Assistant Examiner* — Angela Caligiuri
(74) *Attorney, Agent, or Firm* — John G. Fischer, Esq.; Scheef & Stone, L.L.P.

(57) ABSTRACT

An underwater fairlead assembly has a housing, a wheel, and a plurality of pocket segments. The wheel is connected to the housing by a shaft. The wheel may be a single webbed or a double webbed wheel. A plurality of pocket segments is removably affixed to the outer edges of the wheel. In one embodiment of the present invention, the plurality of pocket segments includes eight removable pocket segments. In an alternative embodiment of the present invention, the plurality of pocket segments includes sixteen removable pocket segment halves. In the closed housing embodiment, the wheel and associated pocket segments are not entirely removable from the housing. In the open housing embodiment, a shaft securing arm secures the shafts, wheel and plurality of pocket segments to the housing.

10 Claims, 3 Drawing Sheets

UNDERWATER FAIRLEAD ASSEMBLY

BACKGROUND OF THE INVENTION

1. Field of the Invention

The present invention relates to offshore drilling vessels. More particularly, the present invention relates to underwater fairleads. Even more particularly, the present invention relates to underwater fairleads with removable pocket segments.

2. Description of Related Art Including Information Disclosed Under 37 CFR 1.97 and 37 CFR 1.98.

An offshore drilling vessel is essentially a massive, floating, mobile vessel used in the offshore exploration and/or production of oil and gas. The vessel is equipped with the necessary drilling tools to drill an oil and gas well into the ocean floor or produce the oil and gas to the surface for recovery. Until recently, the typical offshore drilling vessel was of the type that generally includes two large pontoon hulls, at least four vertical support columns, and a drilling platform. The pontoon hulls float in the water horizontally and are parallel to one another. At least two support columns are attached to and extend vertically upwardly from each pontoon hull. The drilling platform is horizontally attached upon the vertical columns. This type of vessel is sometimes referred to as a "semi-submersible" vessel, and is towed from drilling site to drilling site by one or more boats.

Recently, another type of offshore drilling and production vessel has been introduced to the market; this type of vessel is sometimes referred to as a spar-type vessel. This type of vessel is similar to the older semi-submersible type vessel in that it includes a drilling and/or production platform, but differs in the flotation mechanism upon which the platform rests. More particularly, instead of using pontoon hulls and four vertical supports to support the platform, the spar-type vessel supports the platform with a single, long, slender cylinder, or support column that is vertically moored in the water. This support column is sometimes referred to as a Deep Draft Caisson Vessel, or DDCV. As just one example, the cylinder may have a diameter of approximately 120 feet, and a length of approximately 500 feet. In this example, when moored in the drilling and/or production position, there may be approximately 50 to 80 feet of the cylinder exposed above the water line, with the remainder disposed below the water line.

Irrespective of the type of vessel, whether it be the older "semi-submersible" type or the newer "spar" type, the vessel must be anchored to the ocean floor before drilling begins. With a semi-submersible vessel, which is generally rectangular in shape, there will be at least one large mooring line, and sometimes more than one mooring line, at each corner of the vessel. Each mooring line is in turn connected to a large anchor at the ocean floor. With the spar-type vessel, there will be a number of anchors, perhaps as many as twelve, attached about the circumference of the support column, or DDCV, upon which the platform rests. With both types of vessels, each mooring line is tensioned or relaxed by its own mooring unit, through the use of a wire rope, chain, or combination wire rope/chain mooring line. In very broad terms, a mooring unit is essentially a giant hoist. Each type of vessel is also equipped with a "fairlead" for each mooring unit. A fairlead is essentially a pulley or sheave. The fairleads are mounted to the vessel directly below each mooring unit. With the semi-submersible vessels, the fairleads are mounted to the vertical support members. With the spar-type vessels, the fairleads are mounted directly to the vertical support column, or DDCV. For each mooring unit, the mooring line exits the mooring unit and passes around its corresponding fairlead pulley or sheave before being connected to the anchor.

Various patents have issued in the past relating to underwater fairleads. For example, U.S. Pat. No. 7,240,633 issued on Jul. 10, 2007, to Barlow, describes an underwater chain stopper and fairlead apparatus for anchoring offshore structures. The apparatus has a mounting member, a fairlead member and a chain stopper member. The mounting member is attached to an underwater surface of the offshore structure or vessel and includes a bracket for coupling the fairlead member. The bracket may have a hinge allowing the fairlead member to pivot in an approximately horizontal plane. The chain stopper member is coupled to the fairlead member through a hinge which allows the chain stopper member to pivot with respect to the fairlead member in an approximately vertical plane. The chain stopper member includes a chain stopper flapper having a horseshoe shaped opening at one end. The other end of the flapper is connected to the chain stopper member through a hinge which allows the flapper to swing between an open position and a closed position. In the open position, the chain links for the anchor chain are allowed to pass by the horseshoe shaped opening on the flapper. The horseshoe shaped opening also includes a chain link seat which stops movement of the anchor chain through the chain stopper member when the flapper is in the closed position. The chain stopper flapper moves to the closed position under the force of gravity to provide a self-locking chain stopper. A latch mechanism is provided for latching the chain stopper flapper in an open position.

U.S. Pat. No. 6,148,755 issued on Nov. 21, 2000, to Wudtke et al., describes a removable underwater fairlead. The fairlead is capable of being remotely uninstalled from and then reinstalled on an offshore drilling and production vessel, while the vessel is in its moored position, in the event that the fairlead develops mechanical difficulties that require repair. The fairlead may be remotely uninstalled and reinstalled while the fairlead is underwater and without ballasting the vessel far enough to raise the fairlead above the water surface. This is useful in fairleads that are mounted to a vessel of the type where the ballasting process can be a very difficult, time-consuming, and expensive process.

U.S. Pat. No. 6,817,595 issued on Nov. 16, 2004, to Jenkins et al., describes a swing arm type chain support. The swing arm type chain support has a hook arrangement integral with a swing arm which allows a mooring chain to ratchet over the hook while tensioning, then automatically engages the hook when tension is reduced.

U.S. Pat. No. 4,742,993 issued on May 10, 1988, to Montgomery et al., describes a self-aligning quadrant fairlead. The fairlead is for mooring lines and has an arcuate row of grooved line-engaging shoes of plastic material which shoes can be removed and replacement shoes can be installed without disassembling the mooring line from the fairlead. The fairlead is of generally triangular shape and is supported by trunnion and bearing means at its upper tip and adjacent to its apex enabling the fairlead to swing about an upright axis for self-alignment with a stretch of mooring cable beyond the lower tip of the fairlead.

U.S. Pat. No. 7,104,214 issued on Sep. 12, 2006, to Niebur, teaches a fairlead with an integrated chain stopper. The fairlead is for guiding and securing an anchor chain between an offshore structure and an anchor. The fairlead comprises a fairlead frame, a pivoting latch, and an actuator. The fairlead frame is pivotally mounted to the offshore structure and supports an axle for a chain sheave. The pivoting latch is mounted to pivot on the axle and comprises a tension link with a chain latch and a counterweight for urging the chain latch into engagement with the chain. The pivoting latch is configured to engage the chain only when the chain is traveling in the payout direction. The actuator controls the action of the counterweight.

U.S. Pat. No. 4,070,981 issued on Jan. 31, 1978, to Guinn et al., teaches a mooring system for floating drilling vessels. The mooring system absorbs all of the forces on the vessel, such as wind, current, wave, swell, roll, pitch, heave, surge and sway. These forces are measured by sensing load on a motor, electric, hydraulic, and the like, driving the anchor chain wildcat while hauling it in, by sensing load on the brake bands for the windlass wildcats, and by sensing load on the chain stopper, which sensed loads are transmitted to a display device which provides sufficient information to maintain the drilling vessel within the alignment limits and to warp it into the sea to minimize forces and motions of the vessel and to avoid beam sea forces. A chain counter is provided on the power wildcat which counts the links, and hence the distance, the anchor chain is payed out or hauled in, which is transmitted to the display device. The anchor chains extend from each side both fore and aft of the vessel and each anchor chain has an electric motor driven wildcat, and extends through a chain stopper and fairlead. Vessel alignment is displayed on a cathode ray tube using an acoustic position resonance system.

U.S. Pat. No. 4,311,109 issued on Jan. 19, 1982, to Webb, describes a fairlead. The rotatable fairlead is suitable for use in a deployment, control and recovery of anti-pollution booms, and has two end pieces, two pins, or rollers, which are mounted between the end pieces and spaced sufficiently apart such that a partially inflated boom may pass between the pins. Means are provided for rotating the end pieces and pins through at least 270°. Means for holding them at a given angle of rotation are also provided.

U.S. Pat. No. 5,845,893 issued on Dec. 8, 1998, to Groves teaches an underwater self-aligning fairlead latch for mooring a structure at sea. The fairlead latch device is used for guiding and securing an anchor chain between an offshore structure and an anchor. The fairlead device includes a latch housing pivotally mounted to a fairlead housing. The latch housing includes one or more latches for securing the anchor chain in place. The fairlead housing includes a bending shoe which guides the anchor chain from its orientation within the bending shoe up the platform column to the deck. The fairlead housing is pivotally mounted to the offshore structure.

It is an object of the present invention to provide an underwater fairlead assembly which improves lead times in production and replacement.

It is another object of the present invention to provide an underwater fairlead assembly which reduces the risk of defects in the cast components of the fairlead assembly.

It is yet another object of the present invention to provide an underwater fairlead assembly which has a reduced weight when compared to fairlead assemblies of the prior art.

It is a further object of the present invention to provide an underwater fairlead assembly whose geometry reduces chain link bending fatigue stresses.

It is yet another object of the present invention to provide an underwater fairlead assembly whose geometry reduces chain link bearing stresses.

It is another object of the present invention to provide an underwater fairlead assembly which reduces pocket bearing stresses.

It is another object of the present invention to provide an underwater fairlead assembly which makes retrieval, replacement, or repair of the casting or bearings simpler.

These and other objects and advantages of the present invention will become apparent from a reading of the attached specification.

BRIEF SUMMARY OF THE INVENTION

The present invention is an underwater fairlead assembly having a housing, a wheel, and a plurality of pocket segments. The wheel is connected to the housing by a shaft. The wheel may be a single webbed or a double webbed wheel. A plurality of pocket segments is removably affixed to the outer edges of the wheel.

In one embodiment of the present invention, the plurality of pocket segments includes eight removable pocket segments. In an alternative embodiment of the present invention, the plurality of pocket segments includes sixteen removable pocket segment halves. In one embodiment of the present invention, the housing is a closed housing embodiment. In the closed housing embodiment, the wheel and associated pocket segments are not entirely removable from the housing. Another embodiment of the present invention is the opening housing embodiment. In the open housing embodiment, a shaft securing arm secures the shafts, wheel and plurality of pocket segments to the housing.

DETAILED DESCRIPTION OF THE INVENTION

Figure 1:
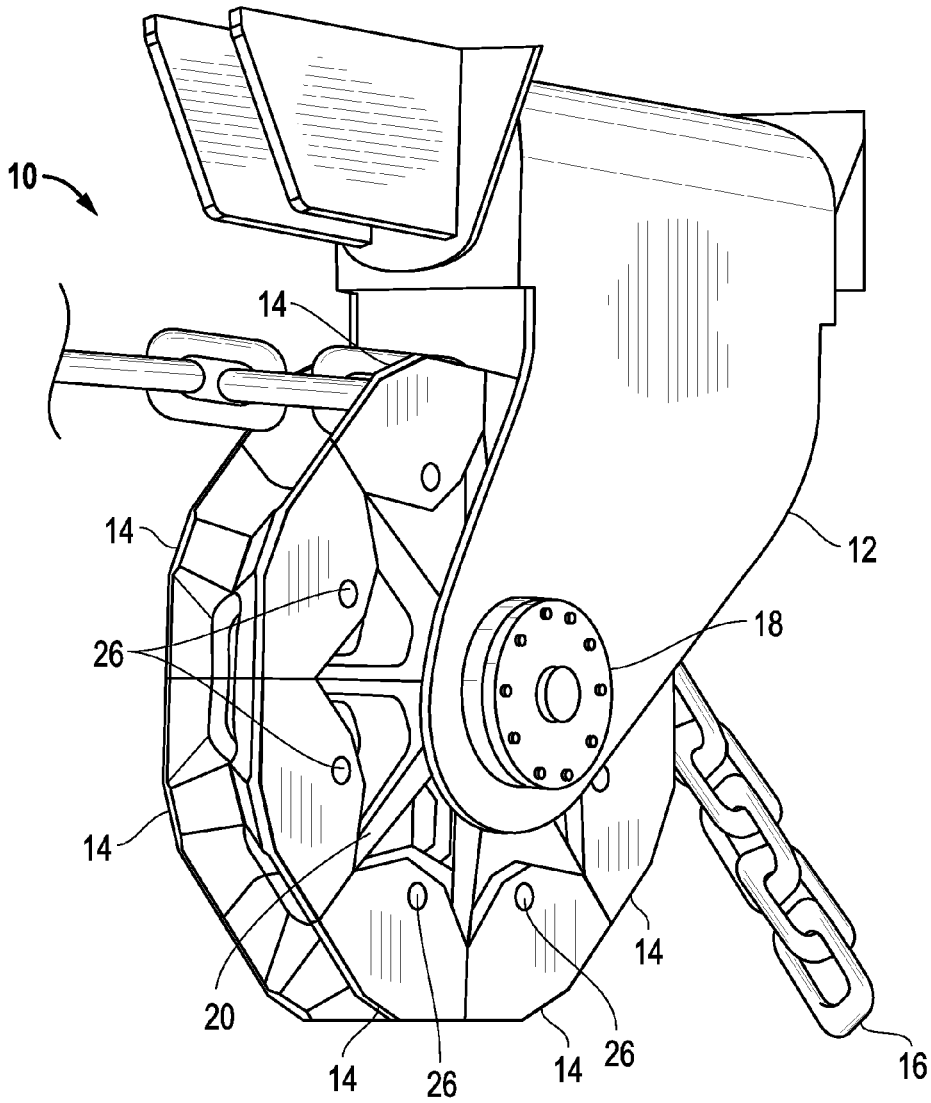
FIG. 1 is an upper perspective view of the fairlead assembly of the present invention showing the closed housing embodiment.

Referring to FIG. 1, there is shown an upper perspective view of the fairlead assembly 10. FIG. 1 shows the closed housing embodiment. In the closed housing embodiment, there is shown the housing 12, and the wheel 20 affixed thereto. The wheel 20 is affixed to the housing 12 via the shaft 18. The shaft 18 runs through the housing 12 and the wheel 20. The wheel 20 may be a single webbed or a double webbed wheel, depending upon the application. In the embodiment shown, the wheel 20 is a single webbed wheel. A plurality of pocket segments 14 are removably affixed to the outer perimeter of the wheel 20.

In FIG. 1, eight pocket segments 14 are shown, two of which are obstructed by the housing 12. A chain 16 runs through the fairlead assembly 10 along the plurality of pocket segments 14. The pocket segments 14 are affixed to the wheel 20 using a series of pin members 26. The pin members 26 are removable by a remotely operated vehicle, or ROV (not shown). The pin members 26 allow for the pocket segments 14 to be easily removed and replaced using an ROV. Additionally, bushings associated with the pocket segments 14 may be removed and replaced with the ROV. Thus, servicing of the fairlead assembly 10 can be accomplished without completely disassembling the assembly 10 or moving the fairlead assembly 10 to the surface.

Figure 1A:
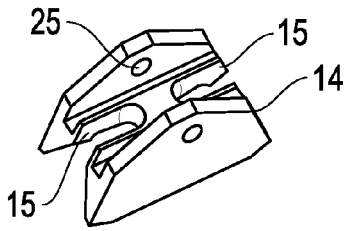

FIG. 1A illustrates a single pocket segment 14 removed from the fairlead assembly 10. Single pocket segment 14 has a shaped recess 15 for engaging links of chain 16 as the fairlead assembly 10 is rotated about the shaft 18. Pin holes 25 receive pin members 26 (FIG. 1) to secure pocket segments 14 to wheel 20.

Figure 2:
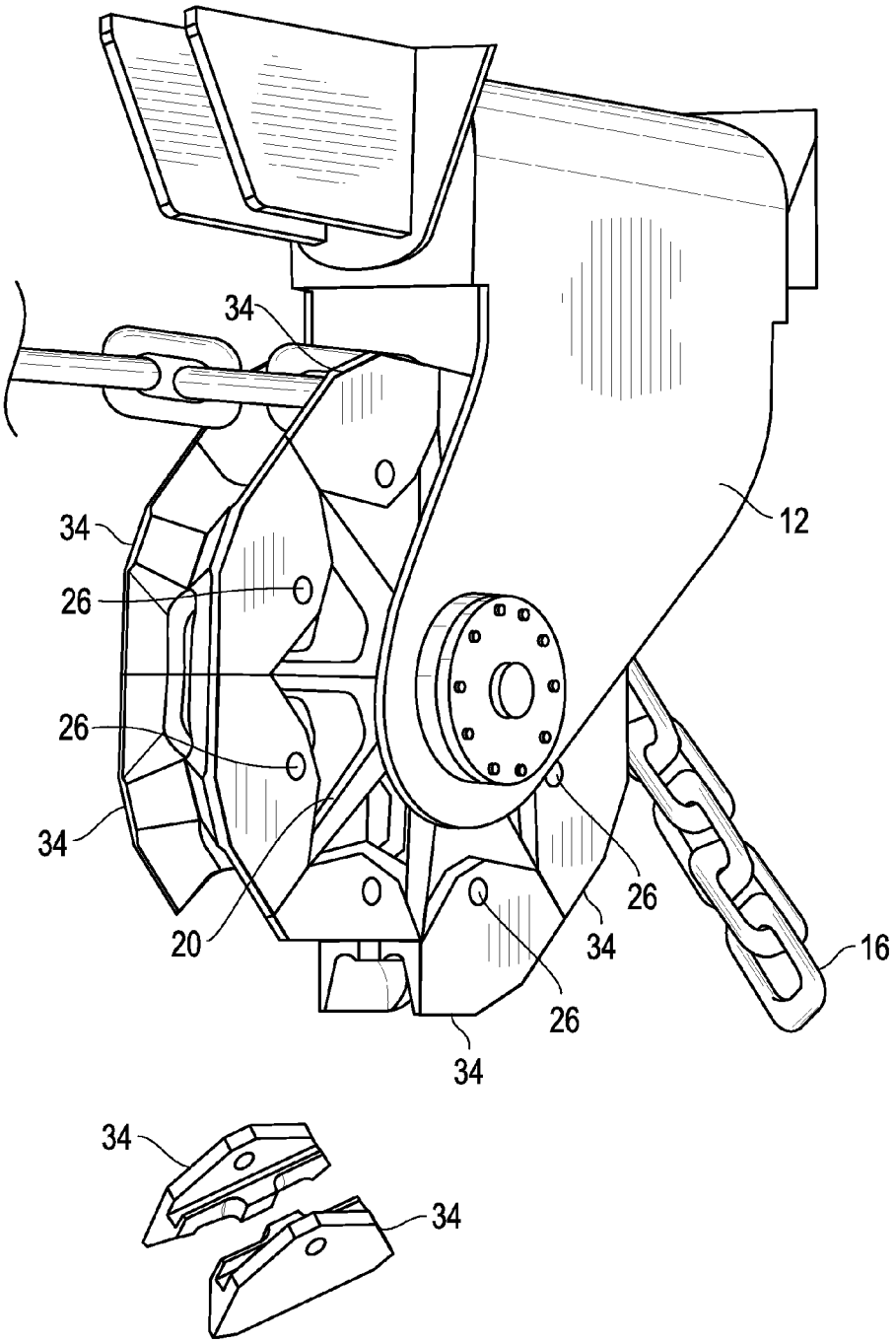
FIG. 2 is an upper perspective view of an alternative embodiment of the fairlead assembly of the present invention having sixteen pocket segment halves.

FIG. 2 shows the closed housing embodiment of the present invention where the plurality of pocket segments 14 have been replaced with sixteen pocket segment halves 34. The pocket segment halves 34 shown in FIG. 2 are essentially halves of an individual pocket segment 14 as shown in FIG. 1. Complimentary segment halves 34 are assembled together to form a segment. The pocket segment halves 34 are similarly affixed to the wheel 20 using a series of pin members 26.

Figure 3:
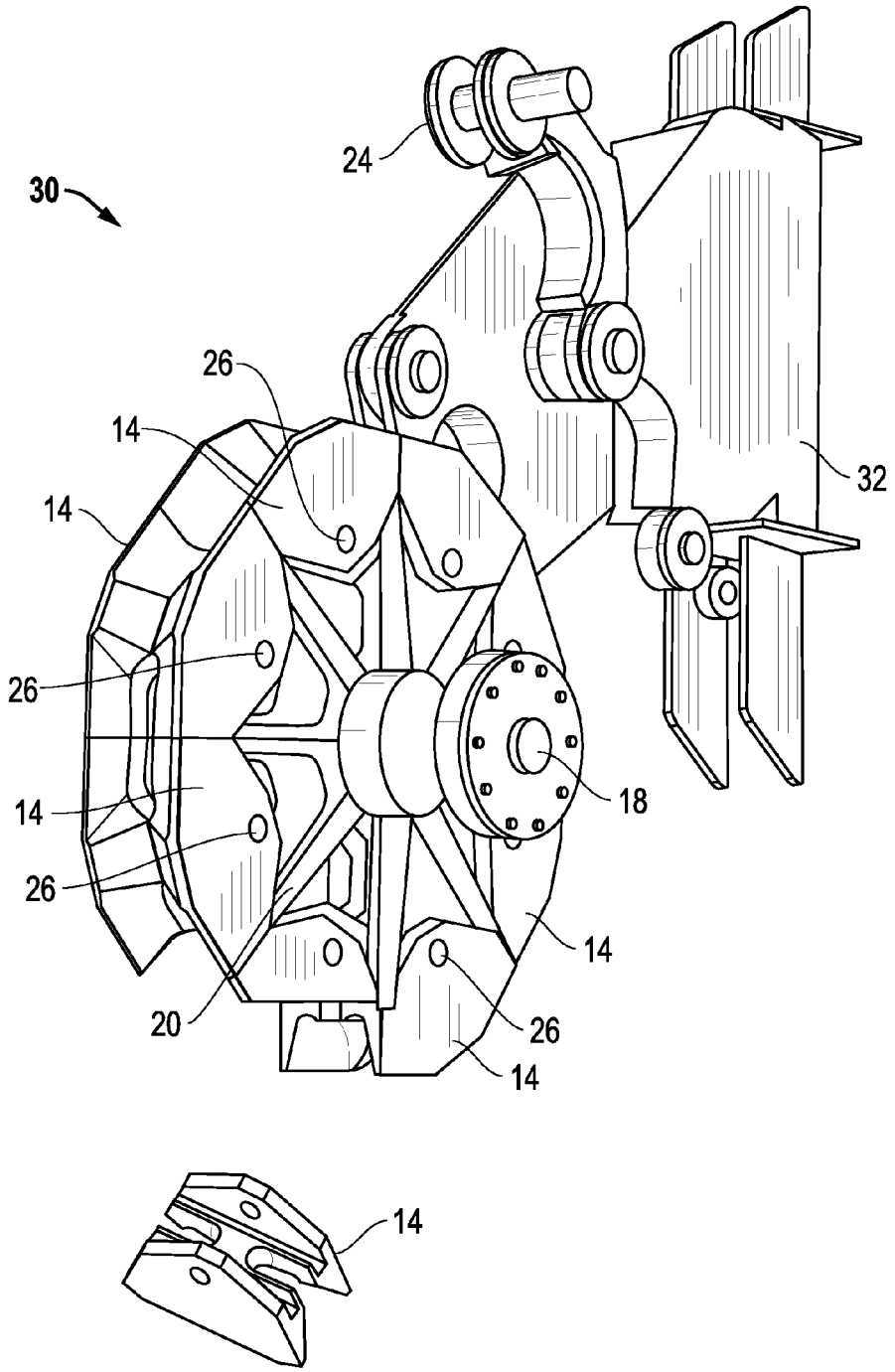
FIG. 3 is an exploded perspective view of an alternative embodiment of the fairlead assembly of the present invention showing the open housing embodiment.

FIG. 3 shows an exploded perspective view of an alternative embodiment of the present invention. FIG. 3 shows a fairlead assembly 30 in an open housing configuration. In the open housing configuration, the housing 32 includes a shaft securing arm 24. The shaft securing arm 24 is movable from a first closed position to a second open position. In the first closed position, the shaft securing arm 24 holds the shaft 18 and wheel 20 in place within the housing 32. In the open position, the shaft securing arm 24 allows the wheel 20, shaft 18 and associated pocket segments 14 to be completely removed from the housing 32. In the open housing configuration, the fairlead assembly 30 similarly includes the pin members 26 which allow for a replacement of the individual pocket segments 14 or associated bushings. The open housing configuration could also include a fairlead assembly 30 with sixteen pocket segment halves 34, rather than the eight pocket segments 14 shown in FIG. 3. In the open housing configuration, shaft removal is not required for servicing of the fairlead assembly 30.

The fairlead assemblies 10, 30 of the present invention have numerous advantages over fairlead assemblies of the prior art. The plurality of pocket segments 14 and pocket segment halves 34 allow for improved lead times and lower risks of defects when casting the various components of the fairlead assemblies 10, 30. For example, the weight of the plurality of pocket segments 14 and pocket segment halves 34 are greatly reduced versus the weights of wheels which are cast with pocket segments in place. The smaller castings have a much better chance of meeting the pass and fail criteria associated with the castings. This lower weight of the pocket segments 14 and pocket segment halves 34 also allows for ROV replacement in the event such a replacement is required. The modular nature of the fairlead assemblies 10, 30 also allows for quick turnaround on design changes.

The geometry associated with the pocket segments 14 and pocket segment halves 34 also leads to improved chain and pocket life. The geometry of the pocket segments 14 and pocket segment halves 34 reduces chain link bending fatigue stresses, bearing stresses and pocket bearing stresses.

The configuration of the fairlead assemblies 10, 30 of the present invention also leads to improved maintenance associated with the wildcat. Retrieval, replacement or repair of the castings or of the wildcat itself is much easier. The open fairlead configuration leads to an easier retrieval, replacement or repair of the wildcat. Further, no overhead hoisting is required for replacement of the bushings by an ROV. Additionally, asymmetric side loads can be well accommodated with the configuration of the fairlead assemblies 10, 30 of the present invention.

The foregoing disclosure and description of the invention is illustrative and explanatory thereof. Various changes in the details of the described method can be made without departing from the true spirit of the invention.

I claim:

1. A fairlead assembly, comprising:

a housing;

a wheel having an outer edge, and being connected to the housing by a shaft;

a plurality of pocket segments, each of the pocket segments having a pair of shaped recesses configured for engaging a portion of two non-sequential links of a chain which runs through the fairlead assembly;

a plurality of pins, the pins removably attaching the pocket segments to the outer edges of the wheel; and, wherein the pocket segments may be removed and replaced without removing the wheel from the shaft.

2. The fairlead assembly of claim 1, further comprising:

the wheel is a single webbed wheel.

3. The fairlead assembly of claim 1, further comprising:

the plurality of pocket segments includes eight removable pocket segments.

4. The fairlead assembly of claim 1, further comprising:

the plurality of pocket segments includes sixteen removable pocket segment halves.

5. The fairlead assembly of claim 1, further comprising:

the housing is a closed housing; and, wherein the pocket segments are individually removable upon partial rotation of the wheel.

6. The fairlead assembly of claim 1, further comprising:

the plurality of pocket segments able to be removed and replaced by a remotely operated vehicle via removal and insertion of the removably attached pin members.

7. The fairlead assembly of claim 1, further comprising:

the housing is an open housing;

a shaft securing arm, the securing arm securing the shaft, wheel and plurality of pocket segments to the housing; and, wherein the pocket segments are individually removable upon partial rotation of the wheel.

8. The fairlead assembly of claim 7, further comprising:

the plurality of pocket segments includes eight removable pocket segments.

9. The fairlead assembly of claim 7, further comprising:

the plurality of pocket segments includes sixteen removable pocket segment halves.

10. The fairlead assembly of claim 7, further comprising:

the plurality of pocket segments able to be removed and replaced by a remotely operated vehicle via removal and insertion of the removably attached pin members.

* * * * *